United States Patent [19]

Kurokawa et al.

[11] 4,240,006

[45] Dec. 16, 1980

[54] PHOTOCONDUCTIVE LAYER AND TARGET STRUCTURE FOR IMAGE PICKUP TUBE

[75] Inventors: Hiromichi Kurokawa, Yokohama; Yasuo Nakamura, Atsugi; Masayoshi Gando, Kanagawa; Haruhiko Okada, Ebina; Masaru Yamazaki, Sagamihara; Hideo Yamanaka, Atsugi, all of Japan

[73] Assignee: Sony Corporation, Tokyo, Japan

[21] Appl. No.: 969,646

[22] Filed: Dec. 14, 1978

[30] Foreign Application Priority Data

Dec. 26, 1977 [JP] Japan ..... 52-156916

[51] Int. Cl.[3] ..... H01J 29/45; H01J 31/38

[52] U.S. Cl. ..... 313/386

[58] Field of Search ..... 313/386

[56] References Cited

U.S. PATENT DOCUMENTS 3,346,755 10/1967 Dresner ..... 313/386 X 3,984,722 10/1976 Maruyama et al. ..... 313/386

OTHER PUBLICATIONS

"Saticon: A New Photoconductive Camera Tube with Se-As-Te Target", by Goto et al., *IEEE Transactions on Electron Devices,* vol. ED. 21, No. 11, pp. 662-666, Nov. 1974.

*Primary Examiner*—Palmer C. Demeo

*Attorney, Agent, or Firm*—Hill, Van Santen, Steadman, Chiara & Simpson

[57] ABSTRACT

A target structure for use with an image pick-up tube is disclosed which has a transparent conductive layer coated on a transparent substrate, a photo-conductive layer on the conductive layer whose main substance is selenium Se, and a semi-insulating oxide layer interposed between the transparent conductive layer and the photo-conductive layer. The semi-insulating oxide layer includes at least one of zinc Zn and cadmium Cd, and at least one of tin Sn and germanium Ge.

7 Claims, 4 Drawing Figures

PHOTOCONDUCTIVE LAYER AND TARGET STRUCTURE FOR IMAGE PICKUP TUBE

BACKGROUND OF THE INVENTION

1. Field of the Invention

The present invention relates generally to a target structure for use with an image pick-up tube, and is directed more particularly to a target structure for use with an image pick-up tube which is simple in construction but effectively avoids deterioration of characteristics.

2. Description of the Prior Art

In the art, an amorphous selenium Se photo-conductive layer has been known as the photo-conductive layer of a target for use with an image pick-up tube. This Se photo-conductive layer is small in lag, so that it is employed widely as the photo-conductive layer of the target for the image pick-up tube. In order to increase the sensitivity for a red color (long wavelength), tellurium Te is added to the Se photo-conductive layer. However, when Te is added to the Se photo-conductive layer, its heat-resisting property becomes low, and especially such a deterioration of characteristics appears that a dark current increases by aging, sensitivity is varied, twinkling is caused and so on.

In order to remove the above defect arsenic As is further added to the Se photo-conductive layer. In this case, if the concentration of As is merely increased, the variation of sensitivity of the layer becomes great upon continuous operation.

To avoid this latter defect, such a target structure using a Se-Te-As photo-conductive layer shown in FIG. 1 is proposed for an image pick-up tube. This target structure consists of a transparent conductive layer 2 made of, for example, $SnO_2$, which is coated on the inner surface of a glass face plate 1 of an envelope of the image pick-up tube, for deriving a signal current, a stabilizing layer i.e. priming layer 3 made of, for example, ZnO or $GeO_2$ coated on the transparent conductive layer 2, a Se-Te-As photo-conductive layer 4 coated on the priming layer 3, and a so-called beam-landing layer 5 made of, for example, antimony trisulfide $Sb_2O_3$ coated on the photo-conductive layer 4. In this case, an electron beam impinges on the layer 5 along the direction indicated by an arrow a in the figure.

The Se-Te-As photo-conductive layer 4 consists of a first protective layer 6, a sensitized layer 7, a second protective layer 8 and a capacitive layer 9 for reducing the electrostatic capacity of the target in this order as shown in FIG. 1. The capacitive layer 9 is made of Se-As photo-conductive layer whose As concentration is lower than, for example 5 atom% and whose thickness is selected sufficiently great, for example, 4 $\mu$m(micron). Each of the first and second protective layers 6 and 8 is made of, for example, a Se-As photo-conductive layer which contains As at relatively high concentration, and the sensitized layer 7 is made of a Se-Te-As photo-conductive layer which contains Te of, for example, 20 atom%.

An image pick-up tube device, which is provided with the above target structure, has less deterioration so that dark current increases upon continuous operation and the sensitivity for the red color is varied upon high temperature (~50° C.) operation and during reservation. It is considered that this advantage is caused by the fact that the diffusion to Te in the sensitized layer 7 is prevented by the existence of the first and second protective layers 6 and 8.

The above target structure is, however, complicated in construction and hence rather expensive.

OBJECTS AND SUMMARY OF THE INVENTION

Accordingly, an object of the present invention is to provide a novel target structure for use with an image pick-up tube.

Another object of the invention is to provide a target structure for an image pick-up tube which is simple in construction but superior in operation.

According to an aspect of the present invention, there is provided a target structure for use with an image pick-up tube comprising a transparent substrate, a transparent conductive layer on the substrate, a photo-conductive layer comprising selenium over the conductive layer, and a semi-insulating oxide layer which is mounted between the conductive layer and the photo-conductive layer, characterized in that said semi-insulating oxide layer comprises at least one IIb metal in the periodic table selected from the group consisting of zinc and cadmium, and at least one IVa metal in the periodic table selected from the group consisting of tin and germanium.

The other objects, features and advantages of the present invention will become apparent from the following description taken in conjunction with the accompanying drawings.

DESCRIPTION OF THE PREFERRED EMBODIMENT

The present invention will be hereinbelow described with reference to the attached drawings.

Figure 1:
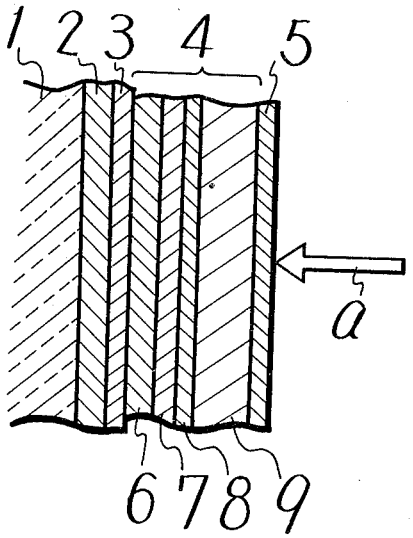
FIG. 1 (PRIOR ART)
FIG. 1 is a schematic cross-sectional view showing a prior art target used in an image pick-up tube.
Figure 2:
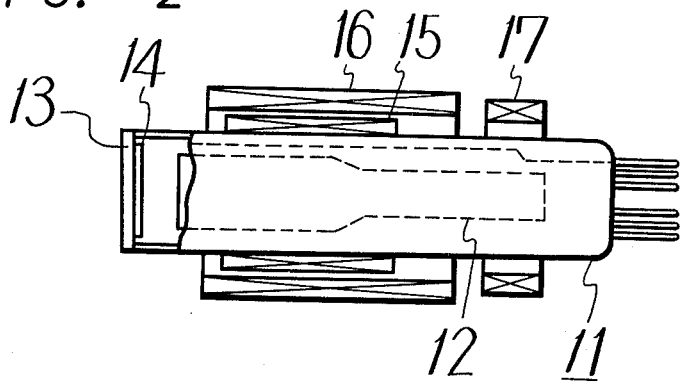
FIG. 2 is a diagram showing an image pick-up tube in which an example of the target structure according to the present invention is used.

Turning to FIG. 2 which shows an image pick-up tube device using an example of the target structure according to the invention, there is provided an envelope 11 in which an electron gun 12 is disposed. On the inner surface of a transparent or glass face plate 13 of the envelope 11 there is located a target structure 14. Around the envelope 11 there are provided a deflection coil 15, a converging coil 16 and an alignment coil 17, respectively.

Figure 3:
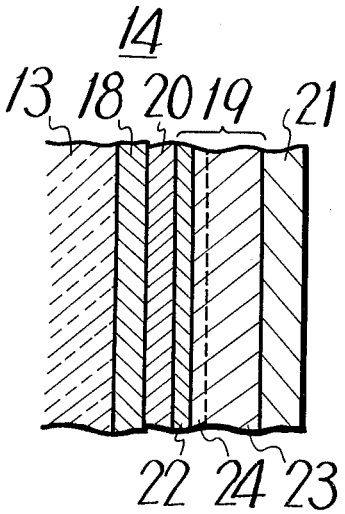
FIG. 3 is a schematic cross-sectional view showing, in an enlarged scale, the target structure of the present invention used in FIG. 2.

As shown in FIG. 3, the target structure 14 of the invention consists of a transparent conductive layer 18 coated on the inner surface of the glass face plate 13 for deriving a signal current and a photo-conductive layer 19 whose main substance is selenium Se. In this case, between the transparent conductive layer 18 and the photo-conductive layer 19 there is provided a stabilizing layer 20 made of a semi-insulating oxide layer, which contains at least one part of zinc Zn and cadmium Cd and at least one part of tin $S_n$ and germanium Ge, and a beam-landing layer 21, which is made of, for example, porous antimony trisulfide $Sb_2S_3$ and has the thickness of, for example, 1000Å(angstrom), is coated on the photo-conductive layer 19.

As shown in FIG. 3, the photo-conductive layer 19 consists of a sensitized layer 22 and a capacitive layer 23 so as to reduce the capacity of the target. The sensitized layer 22 is made of a Se-Te-As photo-conductive layer which has the thickness of, for example, 700Å and contains 20 atom% of Te and 2 atom% of As, and the capacitive layer 23 is made of a Se-As conductive layer which contains 2 atom% of As and has a sufficient thickness, for example, thickness of 4 to 6 μm. The stabilizing layer or semi-insulating oxide layer 20 is made of, for example, $Cd_{2-x}Zn_xSnO_4$ ($1 \leqq x \leqq 2$) which is formed by, for example, DC-sputtering. In this case, a finally obtained composition of the material is sputtered or an alloy $Cd_{2-x}Zn_xS_n$ is sputtered in an atmosphere containing oxygen. The stabilizing layer 20 thus formed is almost amorphous. In this case, the resistance of the stabilizing layer 20, which is formed at the temperature of the substrate (temperature of the face plate 13 on which the transparent conductive layer 18 is formed by spattering), is varied. This resistance shows such a tendency that as the temperature of the substrate becomes high, the resistance decreases. Thus, the temperature of the substrate is desired to be selected lower than 200° C.

Figure 4:
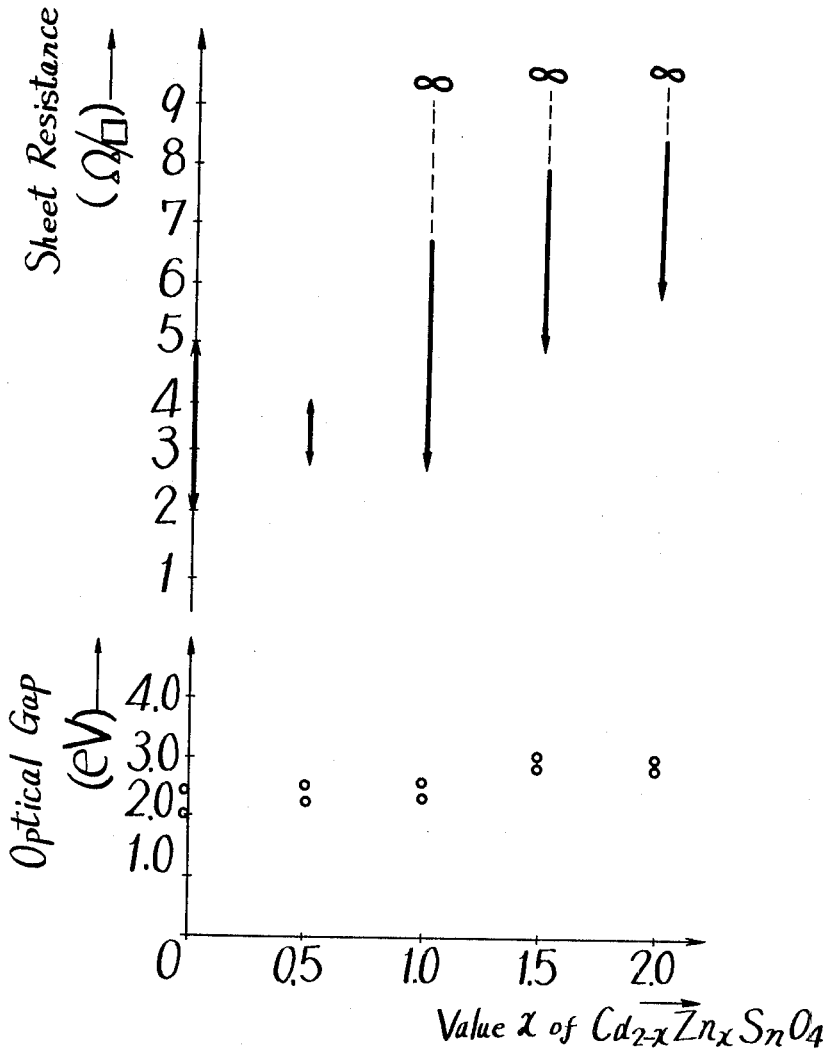
FIG. 4 is a graph showing the relation between the value x of $Cd_{2-x}Zn_xSnO_4$ used in the target structure and a sheet resistance and also an optical gap thereof.

FIG. 4 is a graph showing the distribution of the sheet resistance (Ω/□) of the stabilizing layer 20 by the length of arrows when the value x of $Cd_{2-x}Zn_xSnO_4$ is changed and also the optical gap thereof under the same conditon. As may be apparent from the graph of FIG. 4, as the amount of Zn i.e. value x increases, the optical gap increases, also the sheet resistance increases and hence the blocking (preventing) effect for the dark current becomes high. Therefore, is it desired that the value x is selected greater than 1. By the way when the optical gap is 3.0 eV, the absorption wavelength is 410 mμ (milli-micron) which is very near the lowest wave length of visual light and the spectroscopic characteristic becomes superior.

When the amount of Sn in the substance $Cd_{2-x}Zn_xSnO_4$ becomes greater than a certain value or the substance $Cd_{2-x}Zn_xSnO_4$ does not contain Sn any i.e. it becomes $Cd_{2-x}Zn_xO_4$, there occurs a case such that the stabilizing layer made by sputtering as an amorphous layer is difficult to form with good reproducibility and some times grains appear in a part of or all over the stabilizing layer thus made. In this case, if the thickness of the stabilizing layer is selected to be greater than (~2000 Å), grains are grown, an electric field is generated at the tip end of grains concentrically and hence the dark current is apt to be increased. Further, upon making the stabilizing layer, layers bonded to the inner wall of a bell jar, the substrate, holders (jigs) and so on are easily peeled off therefrom. Thus, pieces of the peeled-off layers are again bonded to the substrate which form flows in the layer.

The transparent conductive layer 18, can be made of $SnO_2$ and the surface thereof can be etched smooth so as to improve the blocking characteristic. Further, the transparent conductive layer 18 can be made of $Cd_{2-x}Zn_xSnO_4$ ($0 < X \leqq 1$).

According to the target structure of the invention described as above, it is ascertained that after the target structure is subjected to the continuous operation for 100 to 200 hours at 35° C., almost no deterioration is caused in the characteristics and the characteristics are stable and, the dark current can be substantially reduced.

The following Table 1 shows examples 1 to 11 of the compositions of the transparent conductive layer 18 and the stabilizing layer 20 used in the target structure according to the invention shown especially in FIG. 3, the composition of comparison examples 1 and 2 (different from the present invention) in which no stabilizing layer 20 of the invention is used, and measured dark currents thereof. In case, of measuring the dark currents, in order to make the measurement easy, the thickness of the capacitive layer 23 is selected as 2 μm, and a target voltage $V_T$ is selected as 50 V and 100 V respectively.

TABLE 1

| | | Transparent Conductive Layer | Stabilizing Layer | Dark Current (nA) $V_T = 50V$ | Dark Current (nA) $V_T = 100V$ |
|---|---|---|---|---|---|
| Example | 1 | $SnO_2$ | $CdZnSnO_4$ | 8 | 220 |
| | 2 | " | $Cd_{0.5}Zn_{1.5}SnO_4$ | 0.9 | 2 |
| | 3 | " | $Zn_2SnO_4$ | 0.5 | 0.7 |
| | 4 | " | $Cd_4GeO_6$ | 16 | 400 |
| | 5 | $Cd_2SnO_4$ | $CdZnSnO_4$ | 4 | 13 |
| | 6 | " | $Cd_{0.5}Zn_{1.5}SnO_4$ | 0.5 | 1.8 |
| | 7 | " | $Zn_2SnO_4$ | 0.6 | 0.8 |
| | 8 | $Cd_4GeO_6$ | $CdZnSnO_4$ | 3.8 | 20 |
| | 9 | " | $Zn_2SnO_4$ | 0.5 | 1.0 |
| | 10 | $Cd_{1.5}Zn_{0.5}SnO_4$ | $CdZnSnO_4$ | 0.6 | 1.5 |
| | 11 | " | $Cd_{0.5}Zn_{1.5}SnO_4$ | 0.5 | 0.5 |
| Comparison Example | 1 | $SnO_2$ | | 660 | |
| | 2 | $SnO_2$ (Sputtering Etching) | | 220 | |

From the above Table 1 it will be apparent that the dark curent can be reduced substantially according to the invention. The reason why the dark current is reduced by the invention can be considered that the stabilizing layer 20 made of the semi-insulating oxide layer having the above composition prevents the injection of holes from the transparent conductive layer 18 to the photo-conductive layer 19.

It is also apparent from the Table 1 that as the amount of Zn increases, the dark current decreases.

The sensitizing effect by Te in the sensitized layer 22 for the red color light appears initially from its concentration of about 10 atom %. Thus, in order to present a sufficient sensitivity for the red color light, the concentration of Te is required to be more than 15 atom %.

Further, it is advantageous that the distribution of Te in the sensitized layer 22 exists at least in the boundary surface between it and the stabilizing layer 20 at the light incident side in view of the conversion efficiency.

The construction i.e. composition and structure of the photo-conductive layer 19 can be changed variously in addition to that described above and illustrated. For example, a protective layer 24 made of a Se-As photo-conductive layer, which contains 20 atom % of As, is interposed between the sensitized layer 22 and the capacitive layer 23 as indicated by a dotted line in FIG. 3.

The above description is given on a single preferred embodiment of the present invention, but it will be apparent that many modifications and variations could be effected by those skilled in the art without departing from the spirits or scope of the novel concepts of the present invention. Therefore, the spirits or scope of the invention should be determined by the appended claims.

We claim as our invention:

1. An image pick-up tube having a target structure comprising a transparent substrate, a transparent conductive layer on said substrate, a photo-conductive layer comprising selenium over said conductive layer, and a semi-insulating oxide layer intervened between said conductive layer and said photoconductive layer, characterized in that said semi-insulating oxide layer comprises at least one II*b* metal in the periodic table selected from the group consisting of zinc and cadmium, and at least one IV*a* metal in the periodic table selected from the group consisting of tin and germanium, wherein said photoconductive layer further comprises tellurium Te and arsenic As, and wherein said oxide layer is made of $Cd_{2-x}Zn_xSnO_4$ ($1 \leqq x \leqq 2$).

2. An image pick-up tube as claimed in claim 1, wherein x is selected 2(x=2).

3. An image pick-up tube as claimd in claim 1, further comprising a beam-landing layer on said photo-conductive layer.

4. An image pick-up tube as claimed in claim 1, wherein said transparent conductive layer is made of tin oxide.

5. An image pick-up tube as claimed in claim 4, wherein said photo-conductive layer includes a sensitized layer and a capacitive layer.

6. An image pick-up tube as claimed in claim 5, wherein a protective layer is mounted between said sensitized layer and said capacitive layer.

7. An image pick-up tube having a target structure comprising a transparent substrate, a transparent conductive layer on said substrate, a photo-conductive layer comprising selenium over said conductive layer, and a semi-insulating oxide layer intervened between said conductive layer and said photo-conductive layer, characterized in that said semi-insulating oxide layer comprises at least one II*b* metal in the periodic table selected from the group consisting of zinc and cadmium, and at least one IV*a* metal in the periodic table selected from the group consisting of tin and germanium, wherein said photo-conductive layer further comprises tellurium Te and arsenic As, and wherein said oxide layer is made of $Cd_4GeO_6$.

* * * * *